US007501620B2

(12) United States Patent
Ogawa et al.

(10) Patent No.: US 7,501,620 B2
(45) Date of Patent: Mar. 10, 2009

(54) LASER IRRADIATION MASS SPECTROMETER

(75) Inventors: Kiyoshi Ogawa, Kyoto (JP); Yoshikazu Yoshida, Kyoto (JP); Kozo Shimazu, Kyoto (JP); Mitsutoshi Setou, Aichi (JP); Shuichi Shimma, Aichi (JP); Michisato Toyoda, Osaka (JP)

(73) Assignees: Shimadzu Corporation, Kyoto (JP); Inter-University Research, Institute Corporation National Institutes of Natural Sciences, Tokyo (JP); Osaka University, Osaka (JP)

( * ) Notice: Subject to any disclaimer, the term of this patent is extended or adjusted under 35 U.S.C. 154(b) by 274 days.

(21) Appl. No.: 11/362,526

(22) Filed: Feb. 27, 2006

(65) Prior Publication Data

US 2007/0045527 A1 Mar. 1, 2007

(30) Foreign Application Priority Data

Aug. 29, 2005 (JP) ..... 2005-247134

(51) Int. Cl.
*H01J 49/26* (2006.01)
*H01J 49/40* (2006.01)

(52) U.S. Cl. ..... 250/281; 250/282; 250/287; 250/288; 250/292

(58) Field of Classification Search ..... 250/281, 250/282, 287, 288, 292
See application file for complete search history.

(56) References Cited

U.S. PATENT DOCUMENTS 5,808,300 A 9/1998 Caprioli
6,107,625 A * 8/2000 Park ..... 250/287
6,777,673 B2 * 8/2004 Chang et al. ..... 250/290
6,963,066 B2 * 11/2005 Izgarian et al. ..... 250/288

FOREIGN PATENT DOCUMENTS

JP 2003-512702 A 4/2003
WO WO 01/29875 4/2001

OTHER PUBLICATIONS

M. Toyoda et al. "Development of a Multi-Turn Time-of-Flight Mass Spectrometer 'MULTUM Linear plus' ", J. Mass Spectrom, Soc. Jpn., vol. 48, No. 5, 2000, p. 312-317.
Y. Naito, "Mass Microprobe Aimed at Biological Samples", J. Mass Spectrom, Soc. Jpn., vol. 53, No. 3, 2005, p. 125-132.

* cited by examiner

*Primary Examiner*—Nikita Wells
(74) *Attorney, Agent, or Firm*—Westerman, Hattori, Daniels & Adrian, LLP.

(57) ABSTRACT

The present invention provides a laser irradiation mass spectrometer capable of analyzing components of living tissue or living cells with high accuracy. It includes a laser unit for irradiating a sample with a beam of laser light and controlling the irradiation spot of the laser beam on the sample; and a mass analyzer for performing a mass analysis of the ions generated at the irradiation spot, where the mass analyzer uses a frequency-driven ion trap and a time-of-flight mass spectrometer to carry out the mass analysis. The ion trap of this system assuredly traps ions having large mass to charge ratios, and enables the system to carry out analyses on samples of large molecules. Preferably, a digital driving method is used to drive the aforementioned frequency-driven ion trap. Also, a multi-turn time-of-flight mass spectrometer may preferably be used as the aforementioned time-of-flight mass spectrometer.

6 Claims, 7 Drawing Sheets

LASER IRRADIATION MASS SPECTROMETER

The present invention relates to a mass spectrometer having an ion source which ionizes a sample by irradiating it with a beam of laser light. Specifically, it relates to a mass spectrometer having an ion source employing the Laser Desorption/Ionization or Matrix Assisted Laser Desorption/Ionization method. These mass spectrometers are typically applied to microscopic mass spectrometers or imaging mass spectrometry.

BACKGROUND OF THE INVENTION

Laser Desorption/Ionization (LDI) is an ionization technique in which a sample is irradiated with a laser light to desorb a substance and to help the change transfer to the substance. Matrix Assisted Laser Desorption/Ionization (MALDI) is another ionization technique suitable for ionizing proteins or other samples that hardly absorb the laser light or are easily damaged by the laser light. In MALDI, a substance that is likely to absorb the laser light and turn into ions is mixed into the sample beforehand as a matrix, and then the mixture is irradiated with a laser light to ionize the sample. Particularly, in recent years, mass spectrometers employing MALDI are widely used in life science or other fields because they enable the analysis of macromolecular compounds having large molecular weights without excessively dissociating the compounds. Moreover, they are also suitable for microanalysis. It should be noted that, in the present specification, mass spectrometers having an ion source using the LDI or MALDI method are generally referred to as the "LDI/MALDI-MS" system.

Microscopic mass spectrometers and imaging mass spectrometers are designed on different conceptual bases. Microscopic mass spectrometers are designed to perform a mass analysis using a visual image of the sample obtained through an optical observation; a microscopic image of the sample is observed through an optical microscope, the target position of the sample is specified on the observed image, and the mass analysis is carried out for the specified position. Imaging Mass spectrometry, on the other hand, are designed to create a fine two-dimensional image of the sample from signals obtained through a mass analysis; they use the result of the mass analysis to identify the texture of the microscopic image.

In any case, LDI/MALDI-MS systems can perform a mass analysis on a minute portion of the sample or obtain a mass image with high resolution by using a laser beam having a very small spot size (see Non-Patent Document 1 or Patent Document 1).

In the present application, these types of mass spectrometers are generally referred to as the "microscopic mass spectrometers."

FIG. 1 shows an example of conventional microscopic mass spectrometers. The operator observes the sample 12 through the charge coupled device (CCD) 11 or ocular lens and specifies the target portion on the observed image. Subsequently, when he or she commands the system to start the analysis, the laser light source 13 casts a train of laser pulses onto the target portion of the sample 12. The observation optics and the laser-irradiation optics are appropriately located taking into account the above-described operations.

The analysis can be performed in various manners. For example, it is possible to specify one point at the time of observation and then carry out the mass analysis for only that point. Otherwise, one may specify a certain area (single or multiple areas) at the time of observation and carry out a two dimensional mass analysis for each area by scanning the area with the beam of laser light at the time of analysis. It is also possible to move the irradiation spot of the laser light beam along a straight or curved line to obtain a line profile of the sample.

The sample ionizes at the portion irradiated with the laser light, the generated ions 14 are pulled by the ion guide 15 into the mass analysis section 16, which performs the mass analysis of the ions. Thus, a mass spectrometry profile of the portion irradiated with the laser light is obtained.

The system shown in FIG. 1 includes an optical system for users to observe an accurate position of the target portion on the sample 12. In general, however, the microscopic mass analysis does not always require an elaborate optical observation system. For example, the microscopic mass analysis may take the following steps: the operator checks the position of the irradiation spot of the laser light by sight or through a simple optical observation means, after which the system performs the mass analysis while moving the sample stage or the irradiation spot of the laser light to obtain two-dimensional mass spectrometry information.

If the mass analysis requires a high level of mass resolution, it is advantageous to use a time-of-flight mass spectrometer (TOFMS) in the mass analysis section 16. The analysis using a TOFMS is based on the idea that the period of time required for an ion accelerated by an electric field to fly over a specific distance depends on the mass of the ion. That is, the period of time is measured from the time the ions are simultaneously released from a predetermined position to the time each ion is detected by the detector after it has flown through a space having a predetermined length. Although the laser light cast onto the sample is in the form of a very short pulse, it produces a large number of ions to be released from different positions with various initial velocities. When a sample is ionized under the atmospheric pressure, the variation on the time of flight of the ions is very large, so that a precise TOF analysis is difficult. To address these problems, an orthogonal acceleration TOFMS as shown in FIG. 1 has been used thus far. In this type of TOFMS, an acceleration voltage is applied in the direction orthogonal to the flying direction of the generated ions 14 so that the ions start their flight from approximately the same position with respect to the detector 17. The TOFMS shown in FIG. 1 is a reflectron type TOFMS, which may be replaced by a linear type TOFMS.

[Patent Document 1] U.S. Pat. No. 5,808,300

[Patent Document 2] Japanese Unexamined Patent Publication No. 2003-512702

[Non-Patent Document 1] Yasuhide NAITO, "Seitai Shiryou Wo Taishou Ni Shita Shituryou Kenbikyou (Mass Microprobe Aimed at Biological Samples)", J. Mass Spectrom. Soc. Jpn., Vol. 53, No. 3, 2005, pp. 125-132

[Non-Patent Document 2] Michisato TOYODA, "Multi-turn Time-Of-Flight Mass Spectrometer 'MULTUM Linear plus' No Kaihatsu (Development of Multi-turn Time-Of-Flight Mass Spectrometer 'MULTUM Linear plus')", J. Mass Spectrom. Soc. Jpn., Vol. 48, No. 5, 2000, pp. 312-317

One of the major objectives of the imaging mass spectrometry or the microscopic mass analysis is to analyze components of living tissue or living cells. In particular, analysis of proteins or sugars (saccharides) contained in a sample taken from a living body is in great demand. One of the effective methods for analyzing proteins, sugars or similar molecules is the MS/MS analysis, in which the ionized sample is dissociated by collision induced dissociation (CID) or similar methods to generate fragment ions (daughter ions), which are then fed to the analysis section. Use of an ion trap will significantly improve the efficiency of producing the fragment ions. The ion trap enables not only the simple MS/MS analysis but also the MS″ analysis, in which the dissociation process repeatedly takes place.

The ion trap has a mass-analyzing capability by itself. However, it has only a low level of mass resolution if it is used independently. To solve this problem, it is advantageous to dispose a TOFMS 22 behind the ion trap 21, as shown in FIG. 2, in order to perform the mass analysis with high resolution during the MS/MS (or MS″) analysis. As shown in FIG. 3, the ion trap 21 temporarily stores ions within its inner space by the radio frequency (RF) voltage applied to the ring electrode 211 and then simultaneously ejects them outside when a direct voltage is applied to the two end cap electrodes 212, 213. The timing of the ejection can be synchronized with the timing at which the ions start their flight inside the TOFMS 22, whereby a high resolution of mass spectrum is obtained. This technique can be also applied to normal modes of MS analysis as well as the MS″ analysis.

The combination of the ion trap 21 and the TOFMS 22 enables the MS″ analysis to be efficiently performed and both the normal MS analysis and the MS″ analysis to be carried out with high resolution. A laser mass spectrometer including an ion trap combined with a TOFMS as shown in FIG. 2 has already been realized. However, it does not function as a microscopic mass spectrometer.

In such mass spectrometers conventionally used, the storage, ejection and other operations of ions within the ion trap are performed by varying the amplitude of the voltage applied to the ring electrode of the ion trap. This method needs a high level of RF voltage to the ring electrode if an ion having a large mass (or a large mass-to-charge ratio) is to be trapped. However, generation of a high RF voltage requires a large-size power supply. Furthermore, the problem of electric discharge needs to be addressed. Thus, the conventional mass spectrometers have the limitation that they cannot practically trap the ions having large mass to charge ratios.

As stated earlier, there is a growing demand for microscopic mass spectrometry or imaging mass spectrometry that is applicable to the mass analysis of bio-samples. In the case of measuring a bio-sample, it is necessary to set the sample as is on the sample stage throughout the analysis. This setting makes it difficult to reduce the molecular weight of the sample by, for example, digesting the sample with an enzyme. Therefore, it is strongly desired that samples having large mass to charge ratios be analyzed at the ion trap.

Conventional mass spectrometers also have a problem relating to the mass resolution in addition to the above-described problem that the ion trap can trap ions only within a limited mass range. The mass resolution of conventional linear TOFMS or reflectron TOFMS is approximately 10000, while there are many proteins and other molecules whose mass to charge ratio exceeds tens of thousands. Therefore, it is impossible to carry out a satisfactory analysis with the conventional mass spectrometers when a highly accurate mass analysis of components of living tissue or living cells is demanded.

The object of the present invention is therefore to provide a laser irradiation mass spectrometer capable of solving the problems described thus far, which is particularly suitable for analyzing bio-samples.

SUMMARY OF THE INVENTION

To solve the above-described problems, the present invention provides a laser irradiation mass spectrometer, which includes:

a laser unit for irradiating a sample with a beam of laser light and controlling the irradiation spot of the laser beam on the sample; and a mass analyzer for performing a mass analysis of the ions generated at the irradiation spot, where the mass analyzer uses a frequency-driven ion trap and a time-of-flight mass spectrometer to carry out the mass analysis.

Preferably, a digital driving method is used to drive the aforementioned frequency-driven ion trap.

Furthermore, a multi-turn time-of-flight mass spectrometer may preferably be employed as the aforementioned time-of-flight mass spectrometer.

The laser irradiation mass spectrometer according to the present invention uses a frequency-driven ion trap. This type of ion trap eliminates the necessity of raising the level of the RF voltage to trap ions having large mass to charge ratios; all that is necessary is to control the frequency of the RF voltage (specifically, a lower frequency is used for a larger mass to charge ratio). It is therefore unnecessary to use a large-size RF power supply, and there is no danger of electric discharge. Thus, the present invention makes it easy to produce a mass spectrometer capable of analyzing samples having large mass to charge ratios. The most suitable method for the frequency control of the ion trap is the digital driving method.

Furthermore, the use of the multi-turn time-of-flight mass spectrometer extremely enhances the mass resolution, so that samples having large mass to charge ratios can be analyzed with higher resolutions. Specifically, it enables the microscopic mass spectrometry or imaging mass spectrometry of proteins, sugars or similar molecules to be performed with high accuracy.

BEST MODE FOR CARRYING OUT THE INVENTION

Figure 1:
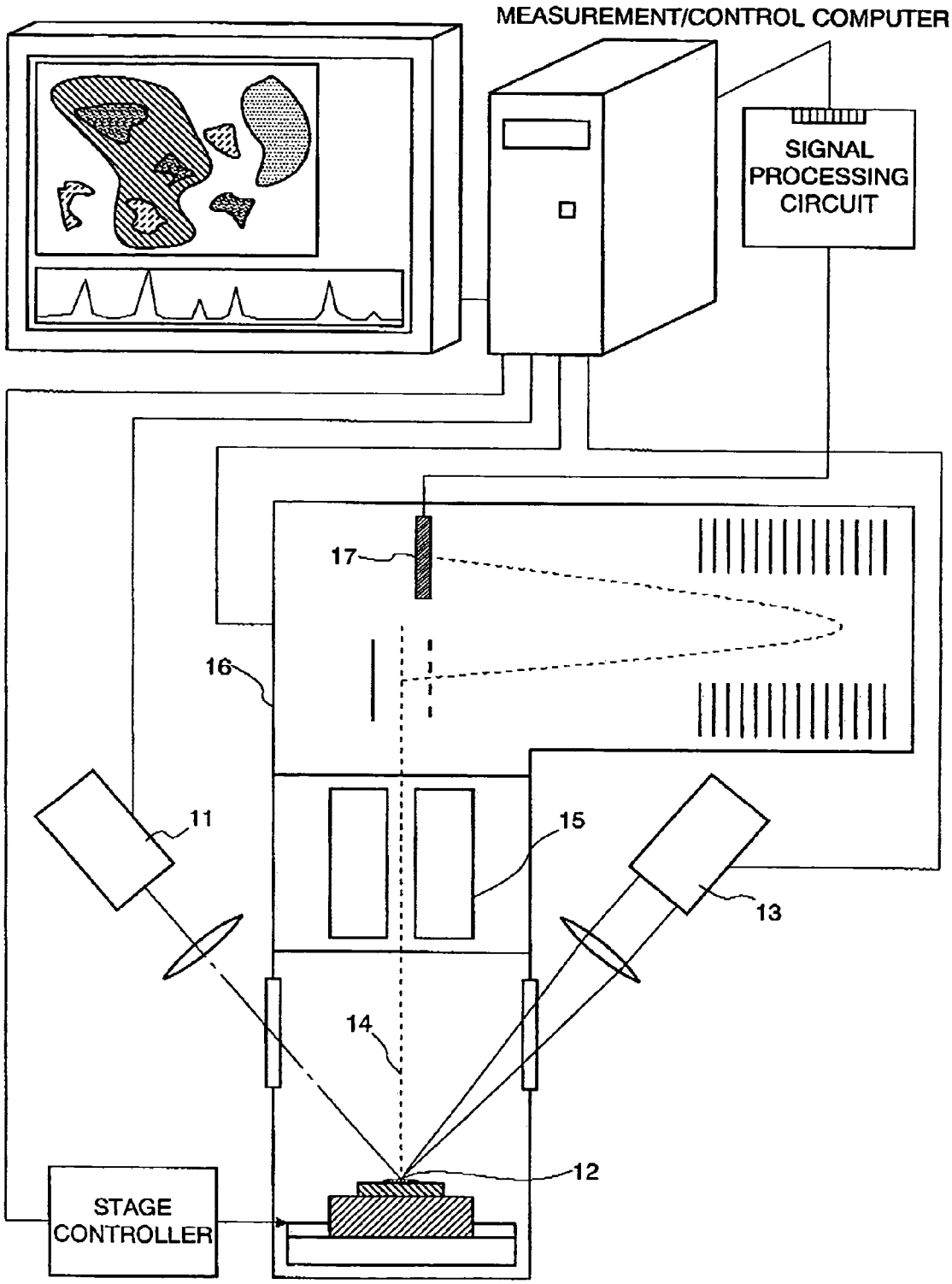
FIG. 1 is a schematic diagram of a conventional microscopic mass spectrometer.
Figure 2:
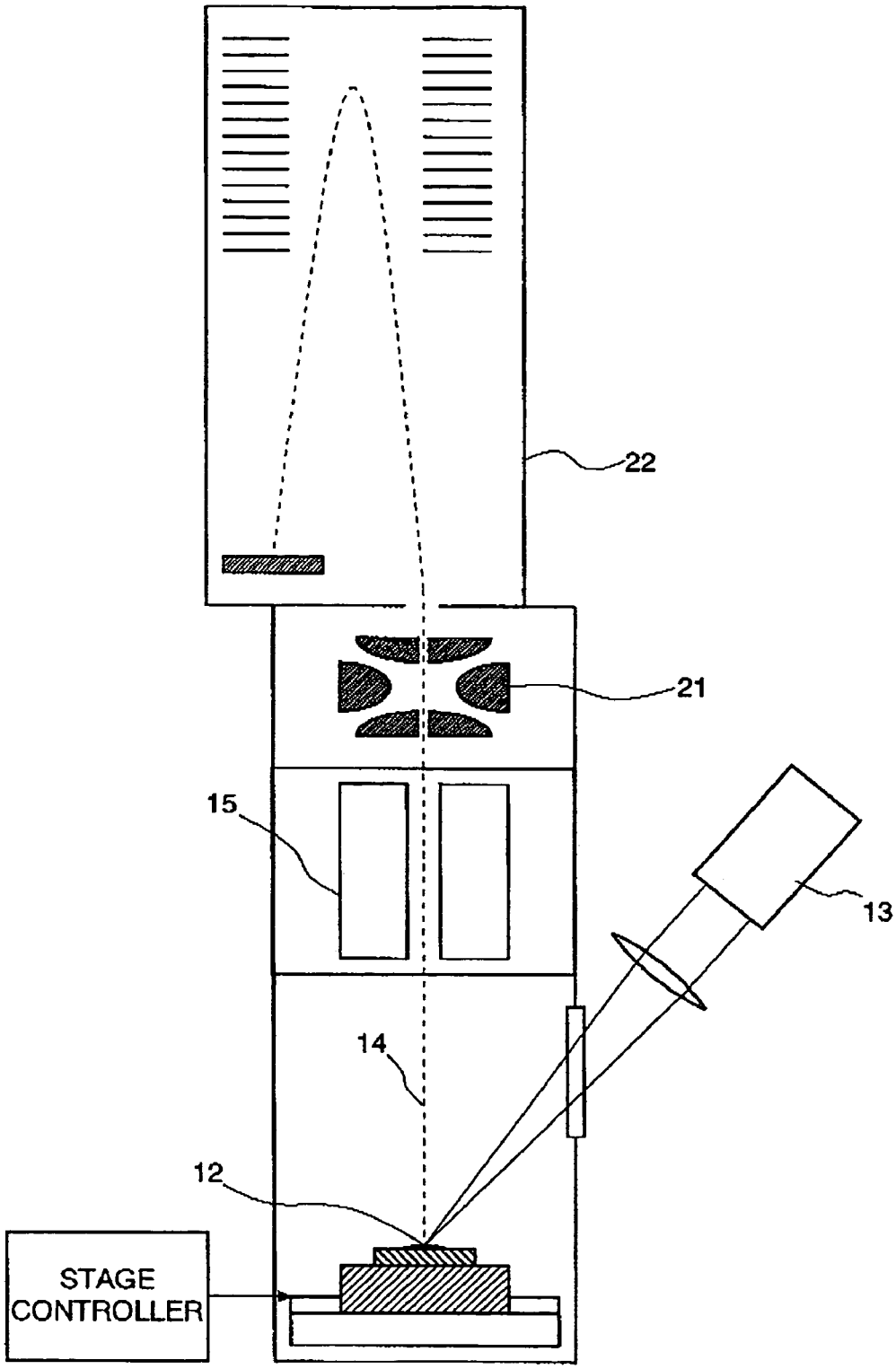
FIG. 2 is a schematic diagram of the main components of a conventional laser mass spectrometer having an ion trap and TOF MS.
Figure 3A:
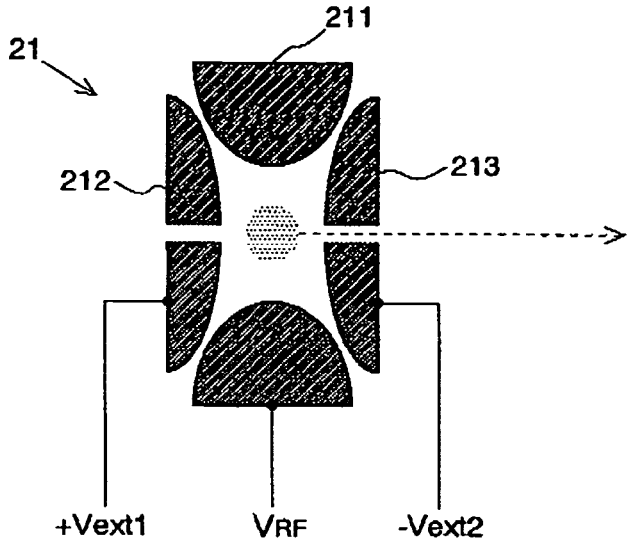
FIG. 3A is a schematic diagram of the ion trap.
Figure 3B:
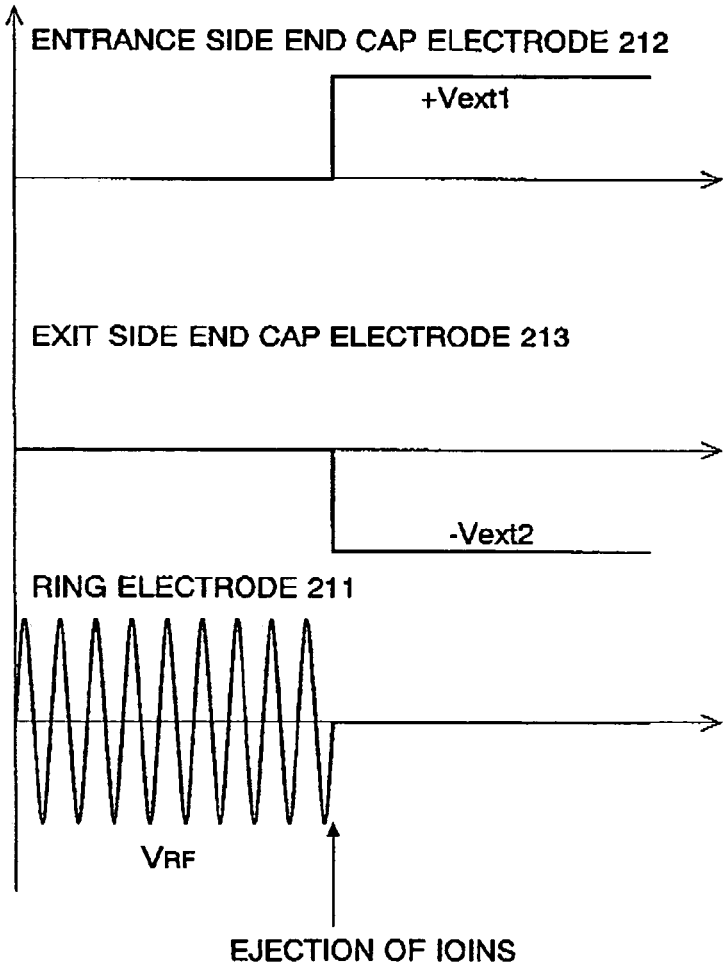
FIG. 3B is a graph showing the change in the voltage applied to the respective electrodes of the ion trap before and after the ions are ejected.
Figure 4:
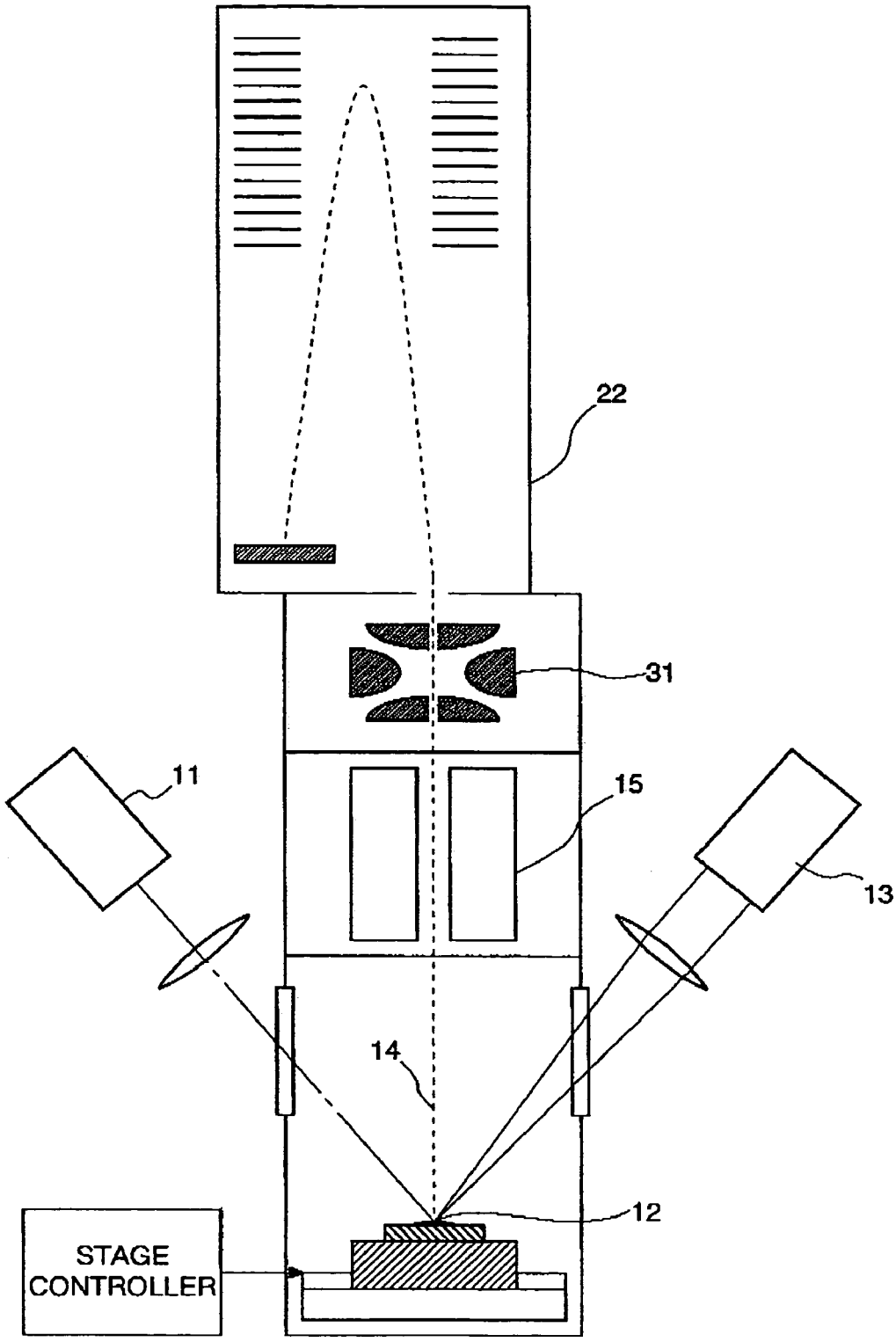
FIG. 4 is a schematic diagram of the main components of a microscopic mass spectrometer having a reflectron time-of-flight mass spectrometer as an embodiment of the present invention.

FIG. 4 shows a microscopic mass spectrometer as an embodiment of the present invention. The present microscopic mass spectrometer includes a frequency-driven ion trap 31 controlled by a digital circuit, and also employs a reflectron time-of-flight mass spectrometer 22. The components engaged in the visual observation, the laser irradiation and the moving (or scanning) operation of a sample are identical to those used in the conventional systems shown in FIGS. 1 and 2. The following description focuses on the behavior of ions generated by the laser irradiation, omitting detailed explanation of the aforementioned components.

Figure 5A:
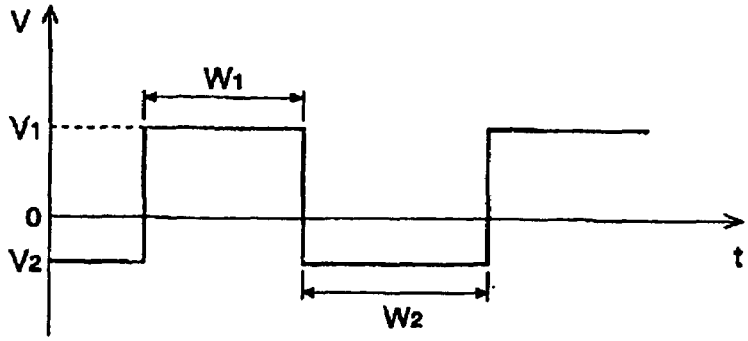
FIG. 5A is a waveform diagram of an RF voltage applied to the ring electrode of the ion trap by digital driving.
Figure 8:
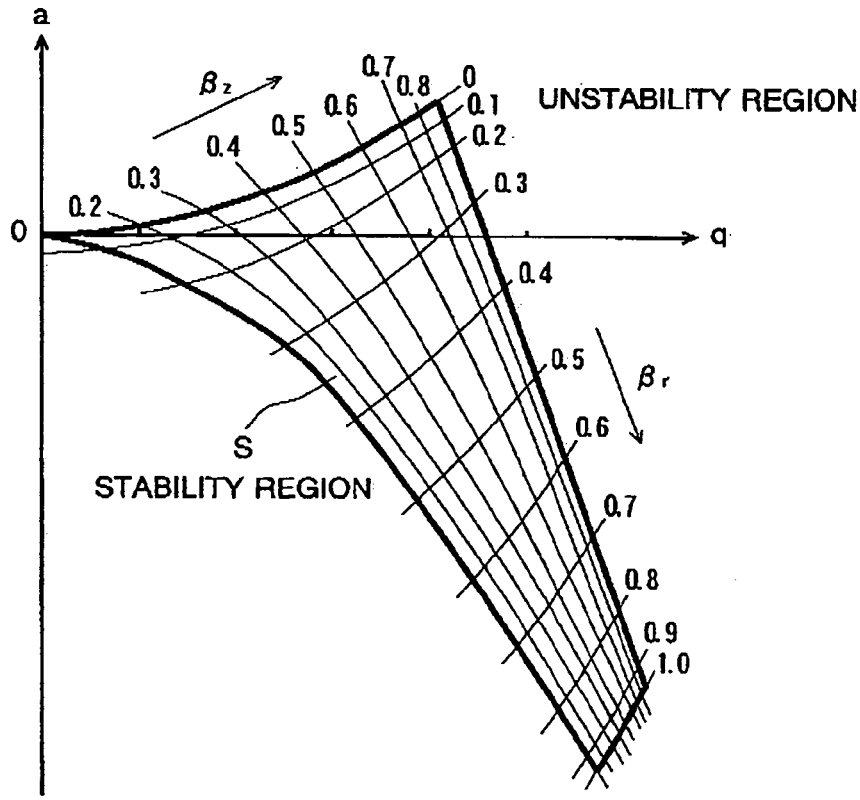
FIG. 8 is an a-q parameter diagram showing the stability region of the ions within the ion trap.

The ions 14 generated from the sample 12 at the irradiation spot are introduced into the ion trap 31 located inside the mass analysis chamber, due to the pressure difference between the sample chamber and the mass analysis chamber and/or the electric field generated by the ion guide 15. The electrodes of the ion trap 31 are also supplied with voltages for introducing the ions 14 into the inner space and holding (or trapping) them inside. As stated previously, the ion trap 31 used in this embodiment is a frequency-driven ion trap, and an RF voltage having a waveform shown in FIG. 5A is applied to the ring electrode of the ion trap 31 by a digital driving circuit shown in FIG. 5B or 5C. In any of these digital driving circuits, the voltages V1 and V2 of the two DC power sources (DC P/S) determine the level of the voltage applied to the ring electrode. The frequency of the applied voltage can be set at desired values by appropriately regulating the time intervals W1 and W2 for applying the respective voltages V1 and V2. Thus, conditions for bringing ions into the stability region S shown in FIG. 8 can be established inside the ion trap 31 by controlling the frequency of the RF voltage, as opposed to the conventional case where the level of the RF voltage is controlled.

Figure 5B:
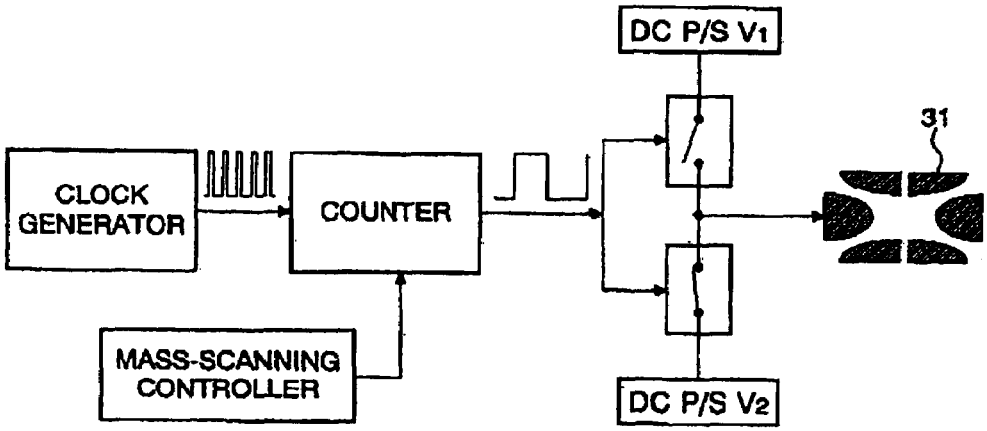
FIGS. 5B and 5C are examples of a digital driving circuit for generating the RF voltage.
Figure 5C:
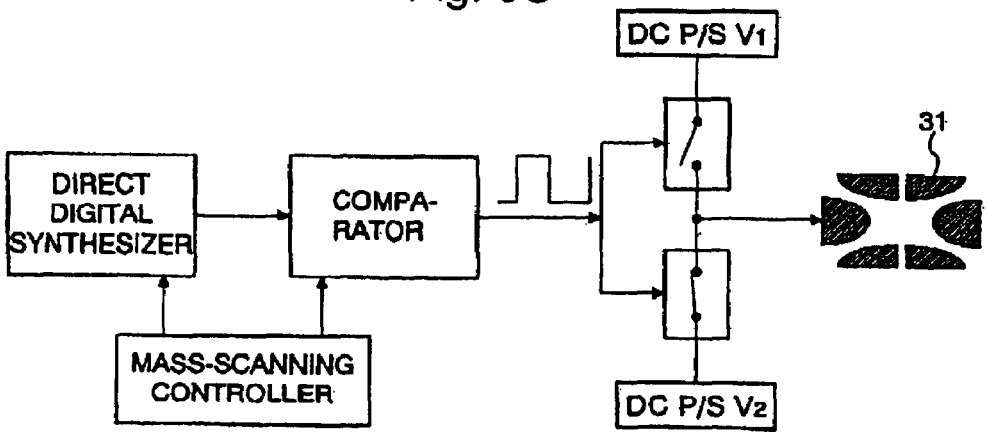

The conventional method, which controls the level of the voltage level, needs a high level of (RF) voltage when ions having large mass to charge ratios are to be trapped. In contrast, the frequency-driven ion trap can trap ions having larger mass to charge ratios by lowering the frequency of RF voltage. The frequency control can be easily achieved using a small and inexpensive digital driving circuit as shown in FIG. 5B or 5C. Thus, it is now feasible to trap ions having large mass to charge ratios without causing the aforementioned problems associated with the generation of high voltage. Even if a bio-sample is used as is, the ions of proteins, sugars or other molecules having large mass to charge ratios can be trapped as is. Thus, the present invention makes it possible to collect much information relating to bio-samples.

Under some circumstance, the ions trapped by the ion trap may be subject to a CID process for fragmentation.

When a high DC voltage is applied between the two end cap electrodes, the ions trapped in the ion trap are simultaneously ejected and then introduced into the time-of-flight mass spectrometer. The ions thus introduced fly freely within an elongated flight space where no electric field is present and are reflected by the reflector (reflectron) located at the other end. The reflected ions again fly through the flight space and enter the detector. The time-of-flight between the time an ion is released from the ion trap and the time the same ion is detected by the detector depends on the mass to charge ratio of the ion. This means that the mass to charge ratio of each ion can be derived from its detection time by the detector.

Within the ion trap, ions located far from the ejecting perforation (exit) are accelerated for a longer time until they reach the exit, while ions located close to the exit are accelerated for a shorter time. Thus, the time-and-space focusing of the ions is achieved at the ejection point. The time-focusing of the ions at the detection point within the reflectron time-of-flight mass spectrometer can be also achieved by making the aforementioned ejection point coincide with the focusing point on the entrance side of the reflectron time-of-flight mass spectrometer. Thus, a high level of mass resolution is achieved.

Figure 6:
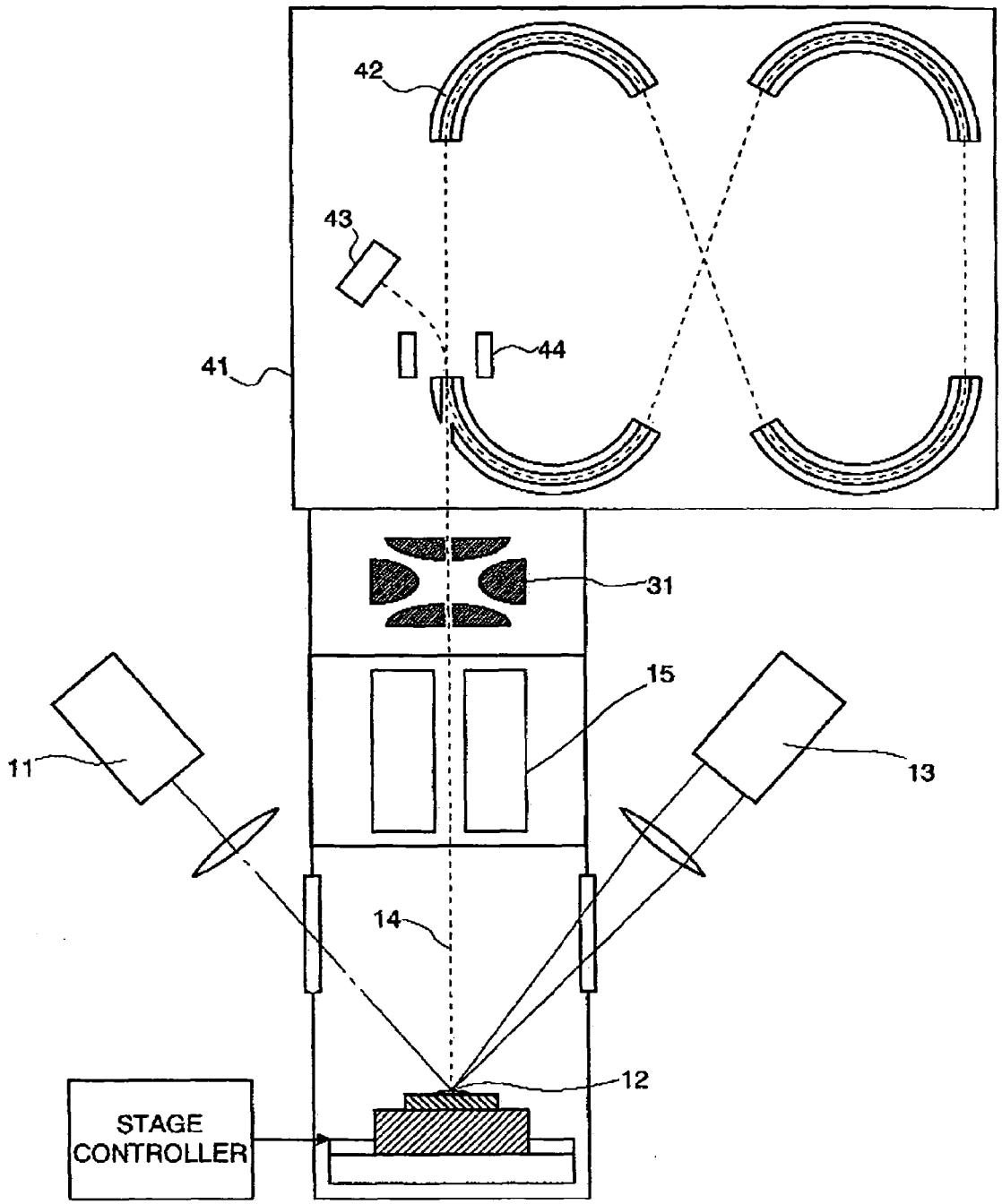
FIG. 6 is a schematic diagram of the main components of a microscopic mass spectrometer including a multi-turn time-of-flight mass spectrometer as another embodiment of the present invention.
Figure 7:
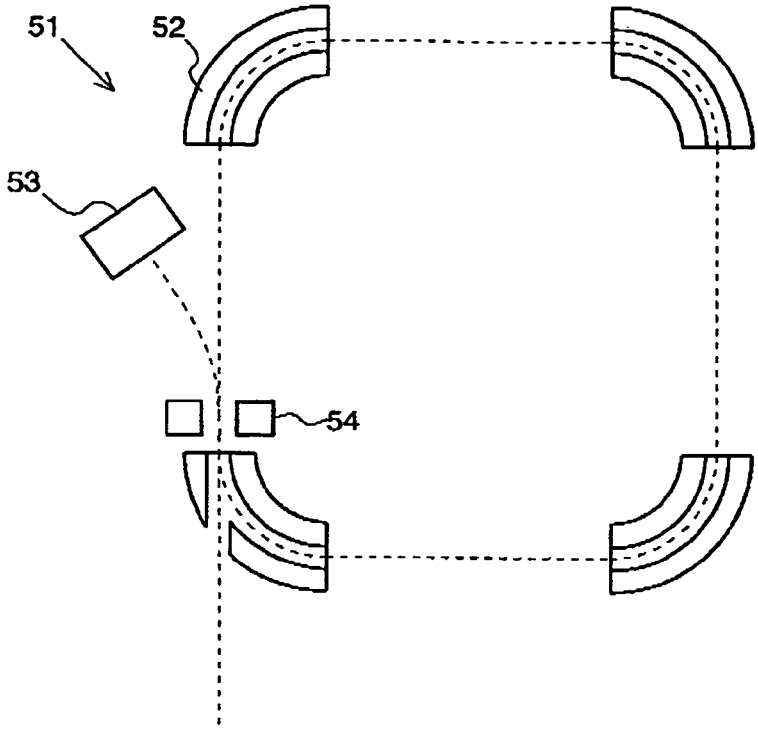
FIG. 7 is a schematic diagram showing a variation of the loop orbit of the multi-turn time-of-flight mass spectrometer.

FIG. 6 shows a microscopic mass spectrometer as another embodiment of the present invention. As in the previous embodiment, the present microscopic mass spectrometer uses a frequency-driven ion trap controlled by a digital frequency-driving circuit. What features the present case is the time-of-flight mass spectrometer, which is now a multi-turn type instead of the reflectron type (see Non-Patent Document 2 for more information about multi-turn time-of-flight mass spectrometers). The multi-turn time-of-flight mass spectrometer shown in FIG. 6 includes an "8" shaped loop orbit, which may be replaced by a simple loop orbit, as shown in FIG. 7.

The ions that have been trapped by the ion trap and ejected outside in the same way as in the previous embodiment enter the multi-turn time-of-flight mass spectrometer 41 (or 51) and fly along the loop orbit predetermined times. By increasing the number of times for the ions to fly in the loop orbit, it is possible to make the flight distance of the ions far longer than in the linear type or reflectron type. The resulting mass resolution can reach a level of 100000 or higher.

In the multi-turn time-of-flight mass spectrometer, an ion that equals the other ions in mass to charge ratio but has a higher level of energy will fly in the outer side of the central path in the deflecting electrode 42 (or 52) located at each corner of the loop orbit, so that its flight distance becomes longer. In contrast, an ion being lower in energy level will fly along the inner side of the central path, so that its flight distance becomes shorter. Accordingly, by appropriately controlling the voltage applied to the respective deflecting electrodes 42 (or 52), it is possible to make plural ions having the same mass to charge ratio leave a certain point and simultaneously return to the same point after making a single turn through the loop orbit, even if the ions have different levels of energy (time/space focusing). If this focusing point coincides with the aforementioned ejection point of the ion trap 31, then a large number of ions released from the ion trap 31 with energy distribution will be focused as they repeatedly fly along the loop orbit. Thus, the mass analysis can be performed with high resolution. The guide electrodes 44 (or 54) for sending the ions to the detector 43 (or 53) are also located to coincide with the aforementioned focusing point.

What is claimed is:

1. A laser irradiation mass spectrometer, comprising:

a laser unit for irradiating a sample with a beam of laser light and controlling a position of an irradiation spot of the beam on the sample; and a mass analyzer for performing a mass analysis of ions generated at the irradiation spot, where the mass analyzer uses a frequency-driven ion trap and a time-of-flight mass spectrometer to carry out the mass analysis.

2. The laser irradiation mass spectrometer according to claim 1, which uses a digital driving method to drive the aforementioned frequency-driven ion trap.

3. The laser irradiation mass spectrometer according to claim 1, which employs a multi-turn time-of-flight mass spectrometer as the aforementioned time-of-flight mass spectrometer.

4. The laser irradiation mass spectrometer according to claim 1, wherein the frequency-driven ion trap and the time-of-flight mass spectrometer are arranged so that the ions generated from the sample are temporarily stored within an inner space of the frequency-driven ion trap and then ejected from the ion trap into a flight space of the time-of-flight mass spectrometer.

5. The laser irradiation mass spectrometer according to claim 4, wherein a point on which the ions ejected from the frequency-driven ion trap are focused with respect to time and space, coincides with a focusing point on an entrance side of the reflectron time-of-flight mass spectrometer.

6. The laser irradiation mass spectrometer according to claim 3, wherein the multi-turn time-of-flight mass spectrometer includes an "8" shaped loop orbit.

* * * * *